US011383533B2

(12) United States Patent
Mieney et al.

(10) Patent No.: US 11,383,533 B2
(45) Date of Patent: Jul. 12, 2022

(54) COMPOSITE DRYER TRANSPORT BELT

(71) Applicant: Xerox Corporation, Norwalk, CT (US)

(72) Inventors: Christopher M. Mieney, Rochester, NY (US); Paul M. Fromm, Rochester, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 309 days.

(21) Appl. No.: 16/205,429

(22) Filed: Nov. 30, 2018

(65) Prior Publication Data

US 2020/0171853 A1 Jun. 4, 2020

(51) Int. Cl.
*B41J 11/00* (2006.01)

(52) U.S. Cl.
CPC ..... *B41J 11/0024* (2021.01); *B41J 11/007* (2013.01); *B41J 11/0015* (2013.01)

(58) Field of Classification Search
CPC ..... B41J 11/007; B65H 2406/3223; B65H 5/224; B65H 2404/56
See application file for complete search history.

(56) References Cited

U.S. PATENT DOCUMENTS 3,399,111 A 8/1968 Beaumont et al.
5,064,509 A 11/1991 Melnyk et al.
5,190,608 A 3/1993 Darcy et al.
6,328,439 B1 * 12/2001 Rhodes ..... B41J 11/007 347/102
6,350,009 B1 * 2/2002 Freund ..... B41J 11/0025 347/101
6,397,488 B1 6/2002 Brinkly
6,716,316 B2 4/2004 Grabscheid et al.
7,182,334 B2 2/2007 Spence et al.
8,317,197 B2 11/2012 DeGruchy
9,637,315 B2 5/2017 Johanson et al.
9,873,980 B2 1/2018 Eagles et al.
2002/0121720 A1 * 9/2002 Davies ..... B29C 70/081 264/103
2006/0028526 A1 2/2006 Nakashima
2012/0141636 A1 * 6/2012 Ackley, Jr. ..... A23G 3/28 426/103
2014/0285602 A1 * 9/2014 Sasaki ..... B41J 11/007 347/102
2015/0165759 A1 * 6/2015 Landa ..... B41J 2/0057 347/103
2018/0264851 A1 9/2018 De Roeck et al.

OTHER PUBLICATIONS

Masse et al., "Mechanical Behavior of Entangled Materials With or Without Cross-Linked Fibers," Scripta Materialia, Elsevier, 2013, vol. 68, pp. 39-43.

* cited by examiner

*Primary Examiner* — John Zimmermann
(74) *Attorney, Agent, or Firm* — Gibb & Riley, LLC

(57) ABSTRACT

A printer is configured to apply marking material to print media to create a printed item, and a transport belt is positioned to receive the printed item from the printer and is configured to dry the marking material on the printed item. The transport belt has a middle layer attached between outer and inner layers, and the printed item contacts the outer layer. The outer and inner layers are non-perforated entangled fiber materials that are porous and that are more flexible than the middle layer.

20 Claims, 5 Drawing Sheets

COMPOSITE DRYER TRANSPORT BELT

BACKGROUND

Systems and methods herein generally relate to printers and printing equipment, and more particularly to a composite dryer transport belt used within printing equipment.

Various substances are used as marking material within printing devices, including wet and dry inks, dry powders (toners), etc. Further, such diverse marking materials can be applied in many different ways, including printing engines that contact the print media, printing engines that spray liquid marking material on the print media, print engines that electrostatically transfer the marking material to the print media, etc. These different marking materials are applied in such different manners in order to meet various goals such as a desired printing speed, a desired printing costs, etc.

One issue that is common among many different types of printers is the need to quickly and economically dry liquid marking materials without distorting either the pattern of the marking material or the underlying print media. Heaters and forced air devices (vacuum plenums used with vacuum belts, etc.) are often included as components in dryers of printing devices.

When vacuum belts are used as the transport belt through such printer dryers, the printed item can have highly visible image quality (IQ) defects in the forms of circles and lines in the process direction that correspond to the holes edges and belt edges. Such defects are caused by thermal conductivity and vacuum gradients created within the print media sheet between areas of the sheet that contact the heated belt and areas of the sheet that cover the vacuum holes or areas of the sheet that are beyond edges of the belt.

SUMMARY

Various apparatuses herein include, among other components a sheet feeder configured to feed print media, a print engine positioned to receive the print media from the sheet feeder and configured to apply marking material to the print media to create a printed item, a transport belt positioned to receive the printed item from the print engine and configured to move the printed item away from the print engine, a heater positioned adjacent to the transport belt and configured to heat the printed item on the transport belt, a vacuum plenum positioned adjacent to the transport belt and configured to draw air through the transport belt, etc. The transport belt, the vacuum plenum, and the heater are configured to dry the marking material on the printed item while the printed item is on the transport belt. The transport belt is a continuous loop belt having opposed parallel edges.

One feature of such apparatuses is that the transport belt comprises a second (or for convenience of discussion "middle") layer between to a first (or for convenience of discussion "outer") layer and a third (or for convenience of discussion "inner") layer. The printed item contacts the outer layer of the transport belt. The top and inner layers are non-perforated entangled fiber (non-woven) materials that are air porous. An adhesive can be included in this structure to bond the top and inner layers to the middle layer. The middle layer can be a solid material that is perforated or a non-preforated woven material. If the middle layer is woven, a sufficient amount of space exists between the woven fibers to allow at least as much air to pass as passes through the upper and lower layers. If the middle layer is solid, the material of the middle layer is not air permeable and air only passes through perforations in the middle layer.

Further, the top and inner layers are more flexible than the middle layer. The outer layer can be a different material from the inner layer, and the top and inner layers can have different flexibilities. The outer layer provides a surface that applies a vacuum force to the print media being held on the transport that is planar and that does not have perforations, which avoids image quality defects that can occur because of the holes in perforated vacuum belts.

In one example, if the middle layer is woven, the fibers of the middle layer are aligned with each other, but are not aligned with, and are not perpendicular to, the edges of the transport belt. In other words, the fibers can be at right angles (90°) to each other, but are at non-parallel, non-perpendicular angles (e.g., 10°, 30°, 45°, 60°, 80°, etc.) to the edges of the transport belt. More specifically, the fibers of the middle layer can, for example, include a first group of parallel linear fibers and a second group of parallel linear fibers, where the first group is arranged perpendicular (90°) to the second group. Additionally, a polymer coating can be included on the middle layer to prevent the first group of parallel linear fibers from moving relative to the second group.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1A:
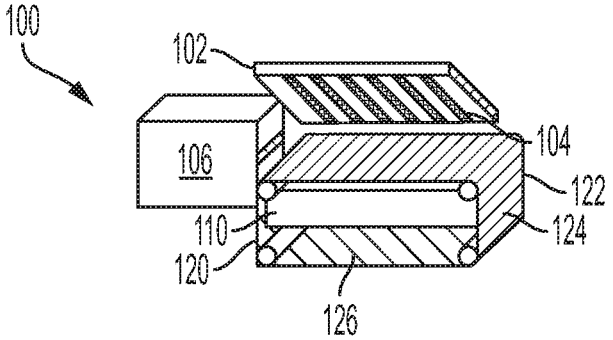
FIG. 1A is a conceptual schematic perspective-view diagram illustrating portions of devices herein.

As mentioned above, when vacuum belts are used as the transport belt through printer dryers, the printed item can have highly visible image quality (IQ) defects in the forms of circles and lines in the process direction that correspond to the belt perforation holes and belt edges. The defects are caused by thermal conductivity and vacuum gradients created within the print media sheet between areas of the sheet that contact the heated silicone belt and areas of the sheet that cover the vacuum holes and/or areas of the sheet that are beyond edges of the belt.

For example, the solvents used in High Fusion (HF) and High Definition (HD) liquid inks for inkjet printers can often be affected by belt perforations and belt edges. In one example, the combination of higher drying temperatures used to dry HF ink on clay coated media and lower boiling points for the co-solvents in HF ink (especially compared to HD ink) results in the HF co-solvents evaporating early in the drying process. Temperature gradients within the print media created by non-uniform thermal loading produced by discontinuous contact between the paper and the silicone belts, and print media and air, causes the co-solvents to evaporate at different rates. This concentrates the ink pigments at the locations of the greatest gradient (i.e., at the edges of the perforation holes or belt edges). The ghost image of the belt is more pronounced with certain colors, such as cyan, but can also be visible in magenta.

Additionally, to keep belts centered on the rollers the ends of some of the rollers can include a crown (area of increased diameter, e.g., 1 mm-3 mm, which results in an incline on the roller ends of 5° to 10°, relative to the roller center). For example, it is not uncommon for the distal 25% of each roller end to have an incline relative to the roller center. The crowns at the ends of the rollers help the belts return to the center of the roller, so as to track properly on the rollers. However, the crowns at the ends of rollers can cause, folding, creasing, or other deformation of the vacuum belt.

In order to address such issues, the systems and methods herein use a multilayer, multi-material vacuum transport belt to transport the printed item through the printer dryer. The "outer" (e.g., top) and "inner" (e.g., bottom) layers of the transport belt are low thermally conductive porous (air permeable) entangled fiber fabric materials laminated onto opposite sides of a "middle" (e.g., center or interior) layer that can be a punched (perforated) or woven stiffer substrate, such as a polyimide film (e.g., 4,4'-oxydiphenylene-pyromellitimide film). Because the air permeable fabrics of the outer and inner layers alone do not possess the dimensional stability to follow the crowns/inclines of the rollers for proper tracking and belt life, the underlying stiffer middle material substrate is used for dimensional stability; however, the permeable inner and outer fabrics maintain a uniform, non-perforated, low thermally conductive flat material against the media face, thereby reducing IQ defects. The materials used for the stiffer substrate allow for air permeability (through perforations or gaps between the woven material) while maintaining dimensional stability, even at elevated temperatures, and the permeable fabrics of the inner and outer layers maintain a uniform (non-perforated) low thermally conductive surface that avoids IQ defects. The air permeable fabric belts may be attached to the stiffer substrate through any number of methods such as, but is not limited to, gluing, melting, laminating, etc.

The outer and inner layers of the laminated transport belt can be formed of any air permeable fabric, such as a flame-resistant entangled fiber, where in one example heat resistant aramid fibers can be hydro entangled into a non-woven air permeable fabric material (e.g. felt). In contrast, the stiffer middle layer can be made from stiff fibers such as fiberglass, etc., formed as a woven fabric (e.g., a screen) with a denim like weave. Advantageously, the fibers of the middle layer can be positioned at 45 degrees to the main orthogonal fibers (which is useful to prevent the orthogonal fibers from "parallelograming" when a tube of the fabric is twisted). In other words, while some of the fibers of the middle layer can be at 90° to the belt edges (or parallel to the belt edges) other fibers are woven at non-parallel, non-perpendicular angles (e.g., 10°, 30°, 45°, 60°, 80°, etc.) to the edges of the middle layer to prevent any of the fibers from bunching, folding, overlapping, etc., within the middle layer, especially in areas of the transport belt that transition to the inclined areas of the crowns at the roller ends. Such non-orthogonal weave of the fibers of the middle layer helps prevent folding, creasing, bunching, etc., of the middle layer. Further, such woven fabrics can include a polymer coating to further rigidize the weave.

With such a laminated transport belt, belt edge IQ defects are eliminated by the use of the low thermal conductivity air permeable fabric. Further, affixing the air permeable fabric to the more dimensionally stable substrate allows for proper belt tracking and life, and because the stiffer substrate is perforated, it allows for air permeability, allowing such to be appropriate for use as a vacuum transport belt.

Figure 1B:
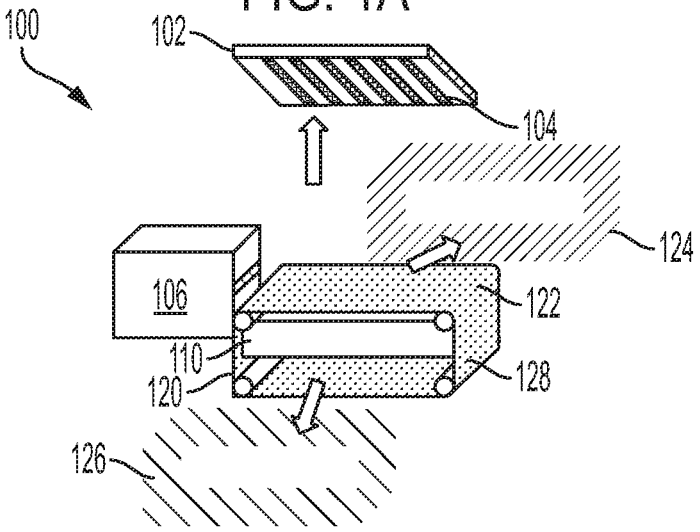
FIG. 1B is a conceptual schematic perspective-view diagram illustrating an expanded view of portions of devices herein shown in FIG. 1A.

FIG. 1A is a conceptual schematic perspective-view diagram illustrating that apparatuses herein include, among other components a print engine 106 (any form of print engine that prints using materials that require drying). FIG. 1B is a conceptual schematic perspective-view diagram illustrating an expanded view of the device(s) shown in FIG. 1A, and FIG. 1C is a conceptual schematic perspective-view diagram illustrating such device(s) in operation (e.g., the print engine 106 applying marking material to print media to create a printed item 108).

Figure 1C:
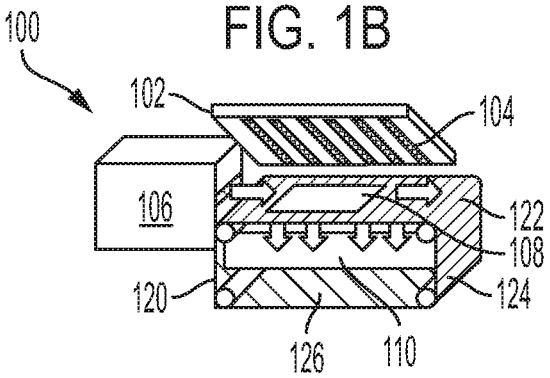
FIG. 1C is a conceptual schematic perspective-view diagram illustrating portions of devices herein in operation.

As shown in FIGS. 1A-1C, these apparatuses also include a transport belt 120 positioned to receive the printed item 108 from the print engine 106 and configured to move the printed item 108 away from the print engine 106, a heater 102 having heating elements 104 positioned adjacent to the transport belt 120 and configured to heat the printed item 108 on the transport belt 120, a vacuum plenum 110 positioned adjacent to the transport belt 120 and configured to draw air (show using downward arrows) through and away from the transport belt 120, etc. The transport belt 120, the vacuum plenum 110, and the heater 102 are configured to dry the marking material on the printed item while the printed item 108 is on the transport belt 120. The transport belt 120 is a continuous loop belt having opposed parallel edges.

Figure 2A:
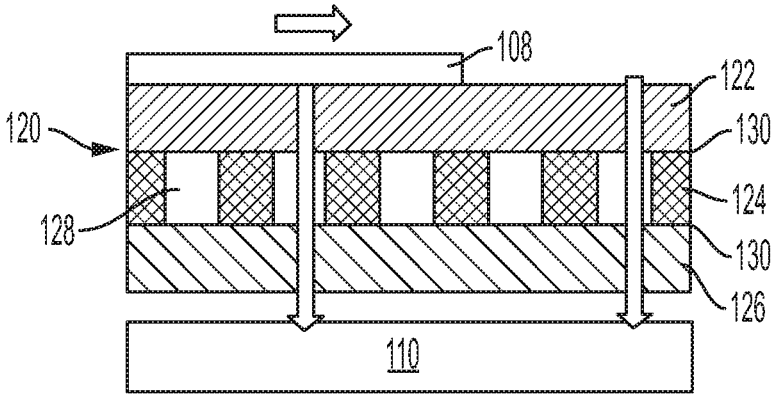
FIG. 2A is a conceptual schematic cross-sectional view diagram illustrating a portion of a transport belt herein.
Figure 2B:
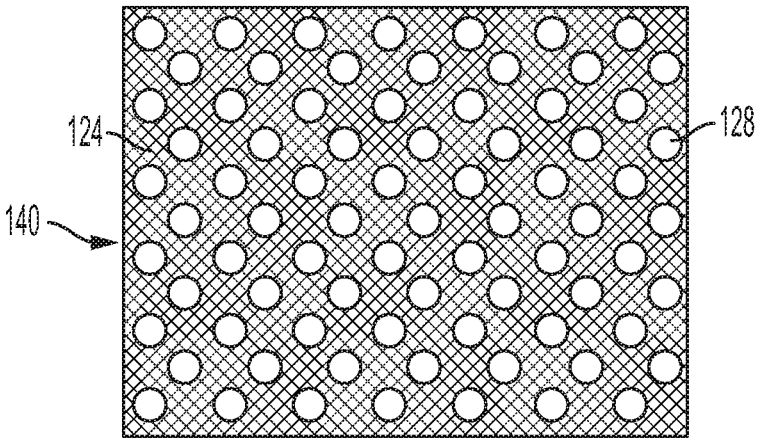
FIG. 2B is a conceptual schematic top view diagram illustrating a portion of the transport belt shown in FIG. 2A.

As shown in the expanded view in FIG. 1B, and shown in cross-section along the mid-line of the transport belt 120 in FIG. 2A one feature of such apparatuses is that the transport belt 120 comprises a second (or for convenience of discussion "middle") layer 124 attached to a first (or for convenience of discussion "outer") layer 122 and to a third (or for convenience of discussion "inner") layer 126. The printed item 108 contacts the outer layer 122 of the transport belt 120. The outer layer 122 and inner layer 126 are porous non-perforated entangled fiber (non-woven) materials through which air can easily pass. The middle layer 124 can be a woven material or a solid material having perforations (openings) 128.

FIGS. 2A (in cross-section) and 2B (in top view) show a perforated solid middle layer 124 having perforations 128. If the middle layer 124 is solid, the material of the middle layer 124 may not be air permeable and air may only pass through the perforations 128 in the middle layer 124. As also shown in FIG. 2A, an adhesive 130 can be included in this structure to bond the upper layer 122 and the inner layer 126 to the middle layer 124.

Further, the inner layer 122 and outer layer 126 are more flexible than the middle layer 124. The outer layer 122 can be a different material from the inner layer 126 126, and the outer layer 122 and inner layer 126 can have different flexibilities/compressibilities. The outer layer 122 provides a surface that applies a vacuum force (shown by downward arrows in FIG. 2A) to the print media 108 being moved in the direction of the horizontal arrow by the transport belt 120. Air is drawn through the porous outer layer 122, the perforations 128 of the middle layer 124, and the porous inner layer 126 by the vacuum applied by the vacuum plenum 110. Note that the that surface of the outer layer 122 upon which the sheet of print media 108 rests is planar flat) and does not have perforations, which avoids image quality defects that can occur when a printed sheet of print media directly contacts perforations or belt edges when multiple parallel perforated vacuum belts are used as the transport belt through printer dryers.

Figure 3A:
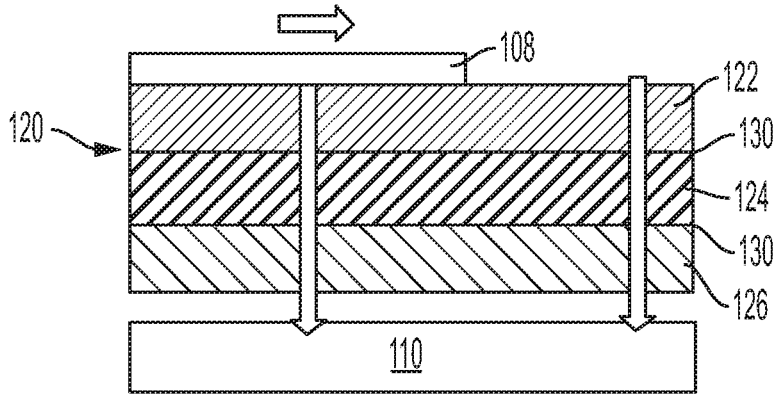
FIG. 3A is a conceptual schematic cross-sectional view diagram illustrating a portion of a transport belt herein.
Figure 3B:
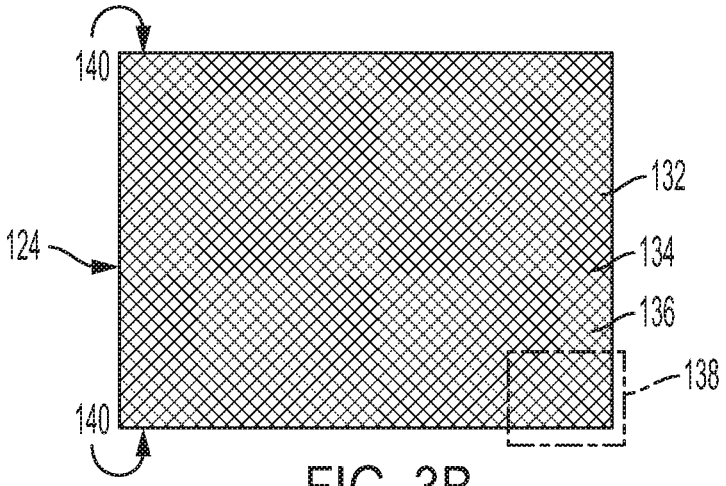
FIG. 3B is a conceptual schematic top view diagram illustrating a portion of the transport belt shown in FIG. 3A.
Figure 3C:
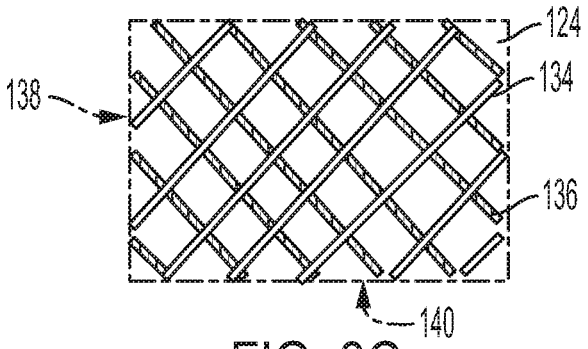
FIG. 3C is an expanded view of a portion of the conceptual schematic top view diagram of a transport belt herein shown in FIG. 3B.

FIGS. 3A-3C illustrate embodiments herein that include a woven middle layer 124, where FIG. 3A is a cross-sectional view and FIG. 3B is a top view diagram illustrating a portion of the middle layer 124; and FIG. 3C is an expanded view of a portion 138 of the top view shown in FIG. 3B. If the middle layer 124 is woven, a sufficient amount of space exists between the woven fibers to allow at least as much air to pass as passes through the upper and lower layers 122, 126. As can be seen in FIGS. 3A-3B, various fibers 134, 136 of the middle layer 124 are aligned with (or are perpendicular to) each other, but are not aligned with, and are not perpendicular to, the parallel edges 140 of the transport belt 120. In other words, the fibers 134, 136 can be at right angles (90°) to each other, but are at non-parallel, non-perpendicular angles (e.g., 10°, 30°, 45°, 60°, 80°, etc.) to the edges 140 of the transport belt 120. More specifically, the fibers 134, 136 of the middle layer 124 can, for example, include a first group of parallel linear fibers 134 and a second group of parallel linear fibers 136, where the first group 134 is arranged perpendicular (90°) to the second group 136. Additionally, a polymer coating 132 can be included on the middle layer 124 to prevent the first group of parallel linear fibers 134 from moving relative to the second group 136.

Figure 4:
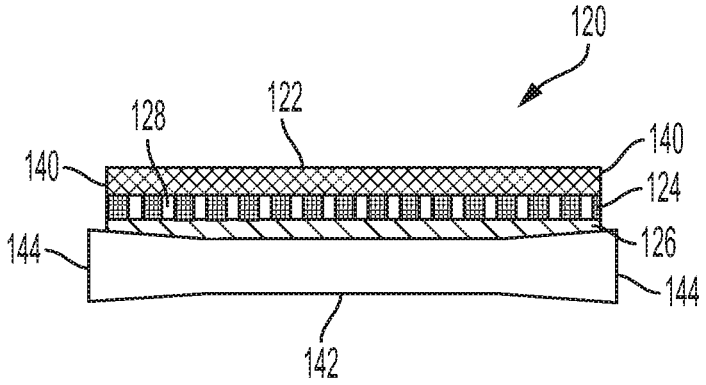
FIGS. 4 and 5 are conceptual schematic cross-sectional view diagrams illustrating a portion of a transport belt herein.

FIG. 4 is conceptual schematic cross-sectional view diagram between the edges 140 of the transport belt 120 herein that illustrates a roller 142 having crowned ends 144 that are inclined relative to the middle of the roller 142. As can be seen in FIG. 4, the flexibility and compressibility of the inner layer 126 accommodates for at least some of the incline of the crowned ends 144 of the roller 142. This helps reduce the amount of bending forces that are applied to the outer sections of the middle layer 124, which in turn reduces the likelihood that creases, folds, etc., will occur in the middle layer 124 and the transport belt 120 as a whole. In other words, the compressibility/flexibility of the inner layer 126 buffers at least some of the force exerted by the incline of the crowned ends 144 of the roller 142 to reduce damage to the middle layer 124.

Figure 5:
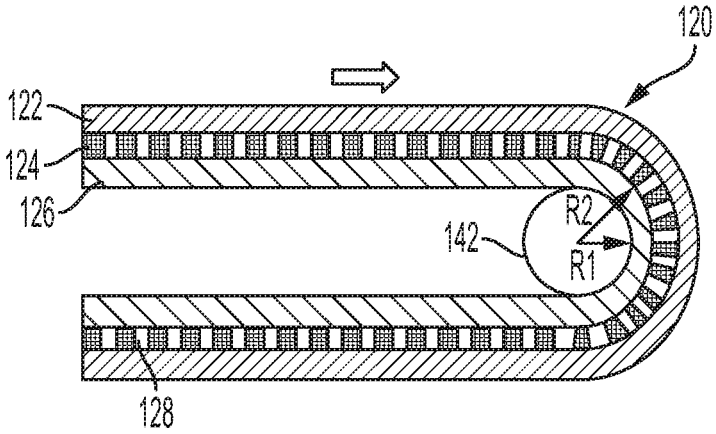

FIG. 5 is conceptual schematic cross-sectional view diagram along the midline of the transport belt 120 herein that illustrates that the inner layer 126 reduces the amount of bending that the middle layer 124 endures as the roller 142 rotates. More specifically, without the inner layer 126 in place the middle layer 124 would contact the roller 142 directly and bend around radius R1; however, with the inner layer 126 in place the middle layer 124 bends less around the larger radius R2. Such an increased radius reduces the bending forces seen by the middle layer 124, which increases the expected useful life of the middle layer 124, and reduces the chances of folding, creasing, etc.

Because of their porous nature, the outer layer 122 and the inner layer 126 are more flexible/compressible than the middle layer 124. However, the flexibility/compressibility of the outer layer 122 may be different from the inner layer 126 because of the different functions they server in such a structure. For example, the inner layer 126 may be more flexible/compressible than the outer layer 122 to allow the inner layer 126 to greatly reduce the amount of bending of the middle layer 124 from the incline of the crowned ends 144, and to allow the surface of the outer layer 122 to remain stiff and non-compressed to provide a flat surface upon which the printed sheet of media 108 is securely held. By having a stiffer, less flexible/compressible outer layer 122, even if strong vacuum forces are experienced from the pressure exerted by the printed sheet of media 108, the outer layer 122 will still maintain a flat surface. The flexibility of the inner layer 126 is limited somewhat in order to still allow the inner layer 126 to provide an increased radius R2 around the roller 142. Therefore, the compressibility of the inner layer 126 is balanced between the need to absorb the incline of the crowned ends 144 and the need to increase the radius R2. To achieve such stiffness, flexibility, compressibility differences, the outer layer 122 and the inner layer 126 can be made of different materials, different densities, different fiber patterns, different diameter fibers, etc.

Thus, as can be seen in FIGS. 1A-5, the outer layer 122 provides a flat, lower temperature surface that is free of perforations that contacts the printed sheet of media 108 so as to avoid image quality defects that can result from temperature differences of conventional perforated vacuum belts within printer dryers. Additionally, the middle layer 124 includes fibers arranged at non-parallel, non-perpendicular angles to avoid creasing, folding, etc. Also, the inner layer 126 has a flexibility/compressibility that is balanced to accommodate at least some of the incline of the crowned ends 144 of the roller 142, while at the same time allowing the inner layer 126 to provide an increased radius R2 around the roller 142, with both operations reducing creases, folds, etc., within the middle layer 124, thereby extending the useful life of the middle layer 124.

Figure 6:
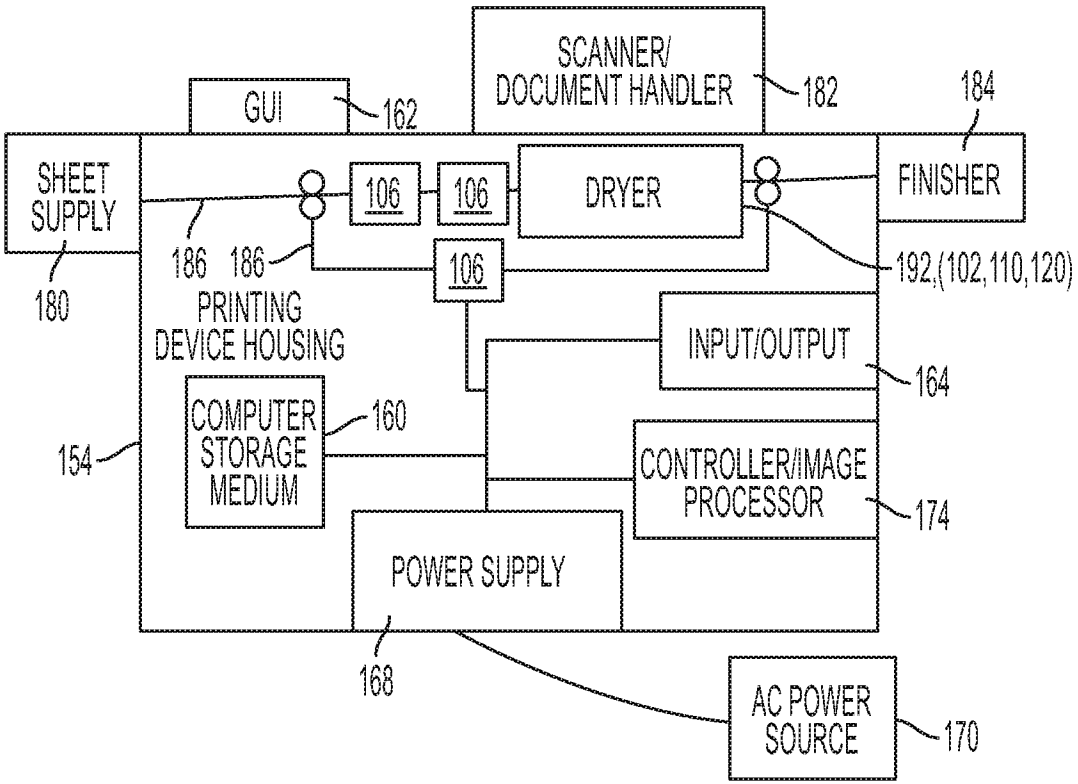
FIG. 6 is a conceptual schematic diagram illustrating a portion of a printing device herein.

FIG. 6 is a conceptual diagram that illustrates many components of printer structures 154 herein that can comprise, for example, a printer, copier, multi-function machine, multi-function device (MFD), etc. The printing device 154 includes a controller/tangible processor 174 and a communications port (input/output) 164 operatively connected to the tangible processor 174 and to a computerized network external to the printing device 154. Also, the printing device 154 can include at least one accessory functional component, such as a graphical user interface (GUI) assembly 162. The user may receive messages, instructions, and menu options from, and enter instructions through, the graphical user interface or control panel 162.

The input/output device 164 is used for communications to and from the printing device 154 and comprises a wired device or wireless device (of any form, whether currently known or developed in the future). The tangible processor 174 controls the various actions of the printing device 154. A non-transitory, tangible, computer storage medium device 160 (which can be optical, magnetic, capacitor based, etc., and is different from a transitory signal) is readable by the tangible processor 174 and stores instructions that the tangible processor 174 executes to allow the computerized device to perform its various functions, such as those described herein. Thus, as shown in FIG. 6, a body housing has one or more functional components that operate on power supplied from an alternating current (AC) source 170 by the power supply 168. The power supply 168 can comprise a common power conversion unit, power storage element (e.g., a battery, etc), etc.

The printing device 154 includes at least one marking device (printing engine(s)) 106 that use marking material, and are operatively connected to a specialized image processor 174 (that is different from a general purpose computer because it is specialized for processing image data), a media path 186 positioned to supply continuous media or sheets of media from a sheet supply 180 to the marking device(s) 106, etc. After receiving various markings from the printing engine(s) 106, the sheets of media can be dried in the dryer 192 (containing the heater 102, transport belt 120, vacuum plenum, etc.) and optionally pass to a finisher 184 which can fold, staple, sort, etc., the various printed sheets. Also, the printing device 154 can include at least one accessory functional component (such as a scanner/document handler 182 (automatic document feeder (ADF)), etc.) that also operate on the power supplied from the external power source 170 (through the power supply 168).

The one or more printing engines 106 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 106 can include, for example, devices that use inkjet printheads, contact printheads, three-dimensional printers, etc.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "outer", "inner", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a printer configured to apply marking material to print media to create a printed item; and a transport belt positioned to receive the printed item from the printer and configured to dry the marking material on the printed item, wherein the transport belt comprises a second layer between a first layer and a third layer, wherein the printed item contacts the first layer, and wherein the first layer and the third layer comprise non-perforated entangled fiber materials that are air porous.

2. The apparatus according to claim 1, wherein the second layer comprises a woven material, and wherein the fibers of the second layer include a first group of parallel linear fibers and a second group of parallel linear fibers, wherein the first group is arranged perpendicular to the second group.

3. The apparatus according to claim 2, further comprising a polymer coating on the second layer preventing the first group from moving relative to the second group.

4. The apparatus according to claim 1, wherein the first layer and the third layer are more flexible than the second layer.

5. The apparatus according to claim 1, wherein the first layer has a different flexibility from the third layer.

6. The apparatus according to claim 1, further comprising an adhesive bonding the second layer to the first layer and the third layer.

7. The apparatus according to claim 1, wherein the second layer comprises a solid material with perforations, and wherein the second layer is not air permeable and air only passes through the perforations in the second layer.

8. An apparatus comprising:

a sheet feeder configured to feed print media;

a print engine positioned to receive the print media from the sheet feeder and configured to apply marking material to the print media to create a printed item;

a transport belt positioned to receive the printed item from the print engine and configured to move the printed item away from the print engine;

a heater positioned adjacent to the transport belt and configured to heat the printed item on the transport belt; and a vacuum plenum positioned adjacent to the transport belt and configured to draw air through the transport belt, wherein the transport belt, the vacuum plenum, and the heater are configured to dry the marking material on the printed item while the printed item is on the transport belt, wherein the transport belt comprises a second layer between a first layer and a third layer, wherein the printed item contacts the first layer, and wherein the first layer and the third layer comprise non-perforated entangled fiber materials that are air porous.

9. The apparatus according to claim 8, wherein the second layer comprises a woven material, and wherein the fibers of the second layer include a first group of parallel linear fibers and a second group of parallel linear fibers, wherein the first group is arranged perpendicular to the second group.

10. The apparatus according to claim 9, further comprising a polymer coating on the second layer preventing the first group from moving relative to the second group.

11. The apparatus according to claim 8, wherein the first layer and the third layer are more flexible than the second layer.

12. The apparatus according to claim 8, wherein the first layer has a different flexibility from the third layer.

13. The apparatus according to claim 8, further comprising an adhesive bonding the second layer to the first layer and the third layer.

14. The apparatus according to claim 8, wherein the second layer comprises a solid material with perforations, and wherein the second layer is not air permeable and air only passes through perforations in the second layer.

15. A transport belt comprising:

a second layer;

a first layer attached to a first side of the second layer; and a third layer attached to a second side of the second layer, opposite the first side, wherein the second layer is between the first layer and the third layer, wherein the first layer is positioned to receive a printed item from a printer, wherein the second layer, the first layer, and the third layer are configured to dry the marking material on the printed item, and wherein the first layer and the third layer comprise non-perforated entangled fiber materials that are air porous.

16. The transport belt according to claim 15, wherein the second layer comprises a woven material, and wherein the fibers of the second layer include a first group of parallel linear fibers and a second group of parallel linear fibers, wherein the first group is arranged perpendicular to the second group.

17. The transport belt according to claim 16, further comprising a polymer coating on the second layer preventing the first group from moving relative to the second group.

18. The transport belt according to claim 15, wherein the first layer and the third layer are more flexible than the second layer.

19. The transport belt according to claim 15, wherein the first layer has a different flexibility from the third layer.

20. The transport belt according to claim 15, further comprising an adhesive bonding the second layer to the first layer and the third layer.

* * * * *